US006133807A

United States Patent [19]

Akiyama et al.

[11] Patent Number: 6,133,807

[45] Date of Patent: Oct. 17, 2000

[54] HIGH-FREQUENCY SWITCH AND INTEGRATED HIGH-FREQUENCY SWITCH ARRAY

[75] Inventors: Shoichi Akiyama; Kazuhiko Adachi; Yutaka Maita, all of Miyagi, Japan

[73] Assignee: Ricoh Company, Ltd., Tokyo, Japan

[21] Appl. No.: 09/270,526

[22] Filed: Mar. 17, 1999

[30] Foreign Application Priority Data

Mar. 20, 1998 [JP] Japan ..... 10-072234

[51] Int. Cl.[7] ..... H01P 1/10

[52] U.S. Cl. ..... 333/101; 200/181; 333/161; 333/262

[58] Field of Search ..... 333/101, 104, 333/105, 161, 262; 200/181; 287/528

[56] References Cited

U.S. PATENT DOCUMENTS 5,121,089 6/1992 Larson ..... 333/107
5,268,696 12/1993 Buck et al. ..... 333/262 X
5,619,061 4/1997 Goldsmith et al. ..... 257/528
5,638,946 6/1997 Zavracky ..... 200/181

*Primary Examiner*—Paul Gensler
*Attorney, Agent, or Firm*—Dickstein Shapiro Morin & Oshinsky LLP

[57] ABSTRACT

A high-frequency switch includes a substrate, external conductors provided on the substrate, and a central conductor provided on the substrate, the external conductors and the central conductor constituting a coplanar high-frequency wave line on the substrate. A deflectable air-bridge is held on the external conductors via an air gap and extends out over the central conductor, the air-bridge being deflectable by an electrostatic field created by an actuation voltage applied between the wave line and the air-bridge. A control-signal conductor generates the actuation voltage between the wave line and the air-bridge. The central conductor acts as the control-signal conductor which generates the actuation voltage between the wave line and the air-bridge. The air-bridge contains a plurality of laminated thin films, the laminated thin films having variable internal stresses that are adjustable to match a particular actuation voltage selected for the switch.

6 Claims, 3 Drawing Sheets

| | SWITCH NUMBER | | | | | |
|---|---|---|---|---|---|---|
| $V_C$ | 101 | 102 | 103 | 104 | 105 | 106 |
| $V_1$ | 0 | 0 | 0 | 0 | 0 | 1 |
| $V_2$ | 0 | 0 | 0 | 0 | 1 | 1 |
| $V_3$ | 0 | 0 | 0 | 1 | 1 | 1 |
| $V_4$ | 0 | 0 | 1 | 1 | 1 | 1 |
| $V_5$ | 0 | 1 | 1 | 1 | 1 | 1 |
| $V_6$ | 1 | 1 | 1 | 1 | 1 | 1 |

0:OFF–STATE
1:ON–STATE

HIGH-FREQUENCY SWITCH AND INTEGRATED HIGH-FREQUENCY SWITCH ARRAY

BACKGROUND OF THE INVENTION

1. Field of the Invention

The present invention relates to high-frequency switches and arrays of high-frequency switches for high frequency signals with micromechanical switch elements, and a method of production of high-frequency switches using integrated circuit fabrication processes.

The present invention is applied to various systems including tuning circuits and transmission/receiving switches of wireless local-area-network systems, phased array antennas, matching-impedance converters, phase shifters, and high-frequency wave sources, which utilize high frequency signals at frequencies of millimeter and sub-millimeter waves.

2. Description of the Related Art

Recently, much attention is focused on high frequency signals at frequencies of millimeter and sub-millimeter waves, as means for high-speed transmission of a large amount of information, which can provide a wide range of available frequency bands for wireless communications. Performance of semiconductor elements at such frequencies of high frequency signals is significantly lowered. A microwave switch of a type having a field-effect transistor on a strip line shows a too small change between the ON-state impedance and the OFF-state impedance in response to a change of a control voltage, and it is difficult to achieve stable, high-speed switching ON/OFF actions.

U.S. Pat. No. 5,619,061 discloses a microwave switch having a micromechanical metal-coated cantilever which acts as a metal-to-metal switch. The microwave switch is fabricated using micromachining.

In the microwave switch of the above publication, a silicon-dioxide cantilever extends out over an opening etched in a silicon substrate. Metal electrodes extend onto the cantilever, and a metal conductor extends onto and up and out over the end of the cantilever. A metal contact on the silicon dioxide lies in the same plane as the cantilever and extends out under the end of the metal conductor.

The microwave switch of the above publication operates as follows. With no voltage applied between the electrodes and the substrate, the cantilever remains parallel to the surface of the substrate, and the switch is open. When a predetermined voltage is applied between the electrodes and the substrate, the cantilever is pulled toward the substrate until the end of the conductor makes contact with the metal contact. This closes the switch. Release of the pull-down voltage then opens the switch. The switch of the above publication is able to show a large change between the ON-state impedance and the OFF-state impedance in response to a change of the voltage, and it can achieve high-speed switching ON/OFF actions in response to the voltage.

Hereinafter, the cantilever or a switch element of this type that acts as the metal-to-metal switch will be called a deflectable air-bridge.

FIG. 4A shows an equivalent circuit of a conventional microwave switch array of the above publication. FIG. 4B shows an equivalent circuit of a phased array antenna utilizing the conventional microwave switch array of FIG. 4A. The conventional microwave switch array of the above publication will be described later, for the purpose of comparison between the conventional microwave switch array and the present invention.

However, there is a problem in the switch of the above publication. That is, the actuation voltage that actuates the switch-ON action of the cantilever depends on mechanical coefficients of the silicon oxide film of the cantilever, and a configuration of the cantilever (for example, the length, the width and the thickness) is determined by taking account of the electrical characteristics (for example, the ON-state impedance). Hence, the switch of the above publication inherently has a fixed value of the actuation voltage, and it is difficult to adjust the actuation voltage to match a particular actuation voltage selected for the switch. When an array of microwave switches of the above publication is formed on a substrate of an integrated circuit chip, each of the microwave switches has the fixed value of the actuation voltage. In order to control individual switching ON/OFF actions of the microwave switches, it is necessary to provide a corresponding number of control-signal conductors, which supply the fixed actuation voltages to the respective switches, on the substrate of the integrated circuit chip. The control-signal conductors provided on the substrate requires a comparatively large area of the integrated circuit chip, and it is difficult to increase an effective area for other elements of the integrated circuit chip on which the switch array is provided.

In practical applications, there is an increasing demand for a high-frequency switch which is operable to connect and disconnect a number of transmission lines through a number of contacts. U.S. Pat. No. 5,121,089 discloses a micromachined electrostatically actuated switch which is adapted to perform switching ON/OFF actions for a number of transmission lines via a number of contacts, and meets the demand. The switch of this publication is fabricated using integrated circuit fabrication processes.

However, the switch of the above publication includes a rotating switch blade which rotates about a hub formed on the substrate under the influence of electrostatic fields created by an actuation voltage. The switching ON/OFF actions are performed by the rotation of the switch blade, and it is difficult to achieve high-speed switching ON/OFF actions in response to the voltage. As the switch of the above publication has a relatively large delay of the switching ON/OFF actions, it is not suitable for use in a phased array antenna which requires high-speed phase shifting actions with the least possible delays.

SUMMARY OF THE INVENTION

An object of the present invention is to provide an improved high-frequency switch in which the above-described problems are eliminated.

Another object of the present invention is to provide a high-frequency switch which increases an effective area for other elements of an integrated circuit chip on which the high-frequency switch is provided, and achieves high-speed switching ON/OFF actions in response to an actuation voltage.

Still another object of the present invention is to provide an integrated high-frequency switch array which increases an effective area for other elements of an integrated circuit chip on which the high-frequency switch array is provided, and achieves high-speed switching ON/OFF actions in response to actuation voltages.

The above-mentioned objects of the present invention are achieved by a high-frequency switch in which external conductors and a central conductor are provided on a substrate, the external conductors and the central conductor constituting a coplanar high-frequency wave line on the substrate, the high-frequency switch including: a deflectable air-bridge which is held on the external conductors via an air gap and extends out over the central conductor, the air-bridge being deflectable by an electrostatic field created by an actuation voltage applied between the wave line and the air-bridge; and a control-signal conductor which generates the actuation voltage between the wave line and the air-bridge, wherein the central conductor acts as the control-signal conductor which generates the actuation voltage between the wave line and the air-bridge, and wherein the air-bridge contains a plurality of laminated thin films, the laminated thin films having variable internal stresses that are adjustable to match a particular actuation voltage selected for the switch.

The above-mentioned objects of the present invention are achieved by an integrated high-frequency switch array having a plurality of high-frequency switches formed on a substrate and connected to a shared control-signal conductor, in which external conductors and a central conductor are provided on the substrate, the external conductors and the central conductor constituting a coplanar high-frequency wave line on the substrate, each of the plurality of high-frequency switches including a deflectable air-bridge which is held on the external conductors via an air gap and extends out over the central conductor, the air-bridge being deflectable by an electrostatic field created by an actuation voltage applied between the wave line and the air-bridge, the central conductor acting to generate the actuation voltage between the wave line and the air-bridge of each high-frequency switch, the air-bridge of each high-frequency switch containing a plurality of laminated thin films, the laminated thin films having variable internal stresses that are adjustable to match a particular actuation voltage selected for the switch, wherein the air-bridges of the plurality of high-frequency switches include at least one thin film having a distinct thickness among the plurality of high-frequency switches.

The above-mentioned objects of the present invention are achieved by an integrated high-frequency switch array having a plurality of high-frequency switches formed on a substrate and connected to a shared control-signal conductor, in which external conductors and a central conductor are provided on the substrate, the external conductors and the central conductor constituting a coplanar high-frequency wave line on the substrate, each of the high-frequency switches including a deflectable air-bridge which is held on the external conductors via an air gap and extends out over the central conductor, the air-bridge being deflectable by an electrostatic field created by an actuation voltage applied between the wave line and the air-bridge, the central conductor acting to generate the actuation voltage between the wave line and the air-bridge of each high-frequency switch, the air-bridge of each high-frequency switch containing a plurality of laminated thin films, the laminated thin films having variable internal stresses that are adjustable to match a particular actuation voltage selected for the switch, wherein the air-bridges of the plurality of high-frequency switches include at least one thin film having a distinct pattern among the plurality of high-frequency switches.

The high-frequency switch of the present invention includes the air-bridge containing the laminated thin films having variable internal stresses that are adjustable to match a particular actuation voltage selected for the switch. The central conductor acts as the control-signal conductor which generates an actuation voltage between the wave line and the air-bridge. The high-frequency switch of the present invention is effective in increasing an effective area for other elements of an integrated circuit chip on which the high-frequency switch is provided, while achieving high-speed switching ON/OFF actions in response to an actuation voltage with the least possible delay. Further, the integrated high-frequency switch of the present invention can be produced by using the integrated circuit fabrication processes, and it can be easily produced with low cost.

The integrated high-frequency switch array of the present invention includes plural high-frequency switches each of which includes the laminated thin films of the air-bridge having variable internal stresses that are adjustable to match a particular actuation voltage selected for the switch, wherein the air-bridges of the plurality of high-frequency switches include at least one thin film having a distinct thickness or pattern among the plurality of high-frequency switches. The integrated high-frequency switch array of the present invention is effective in providing high-speed phase shifting actions with the least possible delays as well as an increase of effective areas for other elements of a phased array antenna on which a phase shifter according to the switch array is provided.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

A description will now be given of the preferred embodiments of the present invention with reference to the accompanying drawings.

The high-frequency switch and the integrated high-frequency switch array according to the present invention are characterized in that both include a deflectable air-bridge of laminated thin films having variable internal stresses that can be adjusted to match a particular actuation voltage selected for the switch, and that a central conductor acts as a control-signal conductor to generate an actuation voltage between a coplanar high-frequency wave line and the air-bridge.

Figure 1:
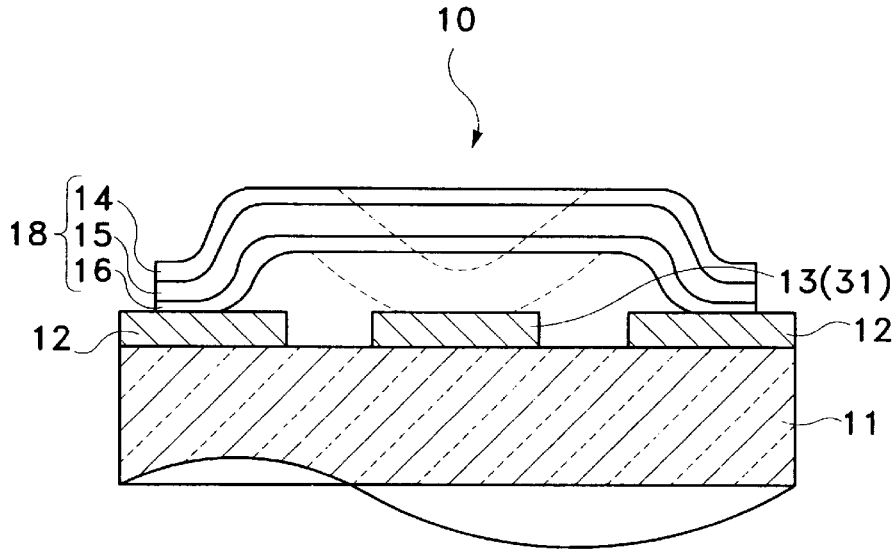
FIG. 1 is a cross-sectional view of a high-frequency switch embodying the present invention.

FIG. 1 shows a high-frequency switch embodying the present invention. Essential features of the high-frequency switch of the present embodiment will now be explained with reference to FIG. 1.

As shown in FIG. 1, the high-frequency switch 10 includes a substrate 11, external conductors 12, a central conductor 13, and a deflectable air-bridge 18. The external conductors 12 and the central conductor 13, both provided on the substrate 11, constitute a coplanar high-frequency wave line on the substrate 11. The air-bridge 18 is formed as an integral part by a set of laminated thin films 14, 15 and 16. The thin film 14 is an upper layer of the air-bridge 18, the thin film 15 is a middle layer of the air-bridge 18, and the thin film 16 is a lower layer of the air-bridge 18. The air-bridge 18 is held on the external conductors 12 via an air gap and extends out over the central conductor 13. The air-bridge 18 is deflectable or can be pulled down by an electrostatic field created by an actuation voltage applied between the wave line and the air-bridge 18. Further, the high-frequency switch 10 includes a control-signal conductor 31 which generates the actuation voltage between the wave line and the air-bridge 18. In the present embodiment, the central conductor 13 acts as the control-signal conductor 31 which generates the actuation voltage between the wave line and the air-bridge 18.

The air-bridge 18 is formed by the laminated thin films 14, 15 and 16, and the thin films 14–16 have variable internal stresses that can be adjusted by film formation and deposition processes so as to match a particular actuation voltage selected for the switch 10. As indicated by a dotted line in FIG. 1, when an actuation voltage is applied between the wave line and the air-bridge 18 through the control-signal conductor 31, the air-bridge 18 is deflected or pulled toward the substrate 11 until the bottom of the air-bridge 18 makes contact with the central conductor 13. This closes the switch 10. With no voltage applied between the wave line and the air-bridge 18, the air-bridge 18 remains parallel to the surface of the substrate 11, and the switch 10 is open. In this manner, the high-frequency switch 10 of the present embodiment can achieve high-speed switching ON/OFF actions with the least possible delays in response to the actuation voltage.

In the present embodiment, the three thin films 14–16 are included in the air-bridge 18. However, the present invention is not limited to this embodiment. The number of the thin films included in the air-bridge 18 is arbitrarily selectable. As described above, the thin films 14–16 of the air-bridge 18 have variable internal stresses that can be adjusted by film formation and deposition processes so as to match a particular actuation voltage selected for the switch 10. Hence, in the high-frequency switch 10 of the present embodiment, the mechanical coefficients of the air-bridge 18 can be adjusted by the film formation and deposition processes so as to match a particular actuation voltage selected for the switch 10, and a particular actuation voltage of the switch 10 can be arbitrarily selected by using the film formation and deposition.

By utilizing the above-described features of the high-frequency switch 10, it is possible to provide an integrated high-frequency switch array in which an array of high-frequency switches 10 shown in FIG. 1 are formed on the same substrate 11, the switches having the same electrical characteristics and mutually-distinct actuation voltages. In an integrated high-frequency switch array of a preferred embodiment of the present invention, the high-frequency switches are connected to a shared control-signal conductor, and respective switching ON/OFF actions of the high-frequency switches can be performed by supplying one of the distinct actuation voltages to the switches 10 through the shared control-signal conductor. Hence, the integrated high-frequency switch array of the present invention can increase an effective area for other elements of an integrated circuit chip on which the high-frequency switches are provided.

Further, in the integrated high-frequency switch array of a preferred embodiment of the present invention, each of the high-frequency switches includes a deflectable air-bridge 18 of laminated thin films having variable internal stresses that can be adjusted to match a particular actuation voltage selected for the switch, and it is possible to achieve high-speed switching ON/OFF actions in response to the actuation voltage. The central conductor 13 acts as the control-signal conductor 31 which generates an actuation voltage between the wave line and the air-bridge 18. It is not necessary to provide a large number of control-signal conductors which supply the fixed actuation voltages to the respective switches as in the conventional microwave switch array. Hence, the integrated high-frequency switch array of the preferred embodiment is effective in increasing an effective area for other elements of an integrated circuit chip on which the high-frequency switches are provided, while achieving high-speed switching ON/OFF actions in response to the actuation voltage with the least possible delay. Further, the integrated high-frequency switch array of the preferred embodiment can be produced by using the integrated circuit fabrication processes, and it can be easily produced with low cost.

Figure 2:
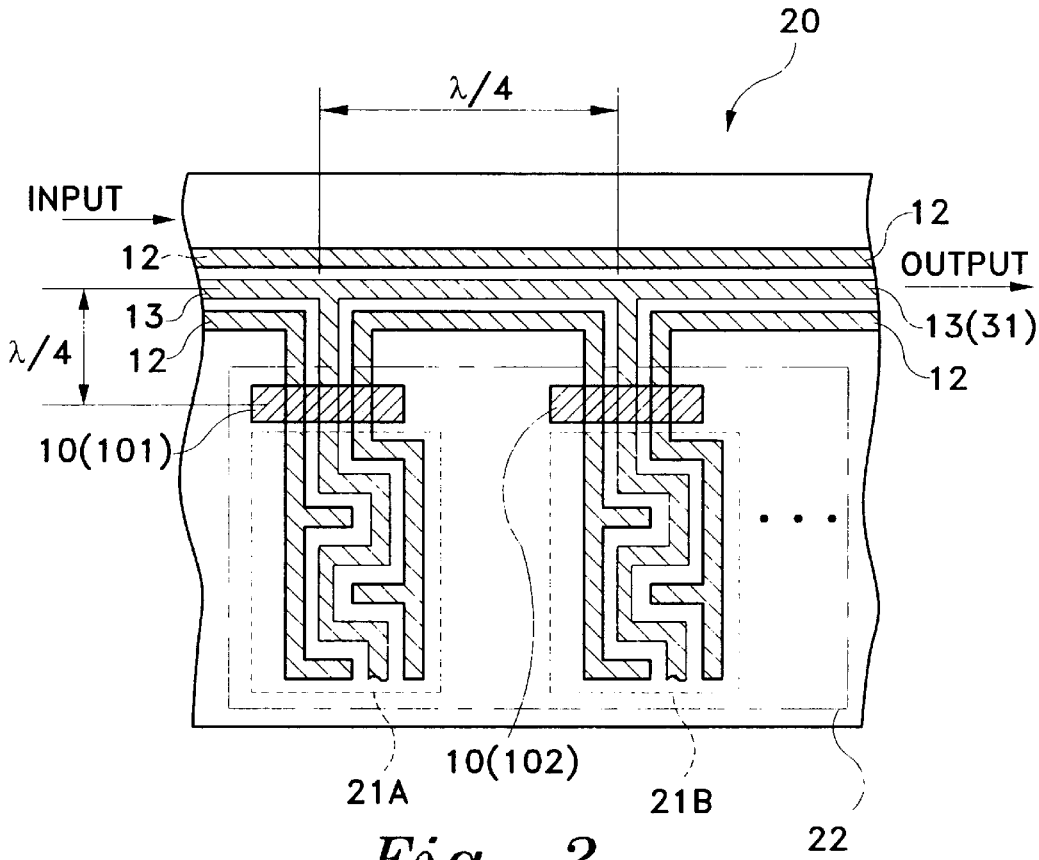
FIG. 2 is a top view of an integrated high-frequency switch array embodying the present invention.

Next, a description will be given of a first embodiment of the integrated high-frequency switch array of the present invention. FIG. 2 is a top view of an integrated high-frequency switch array embodying the present invention. It should be noted that the switch array illustrated in FIG. 2 contains the same spacing between conductors 12 and central conductor 13 as shown in FIG. 1 (which is a cross-sectional drawing).

In the present embodiment, an integrated high-frequency switch array 22 is produced by forming a plurality of high-frequency switches 10 of FIG. 1 on the same substrate 11 and connecting the switches 10 to a shared control-signal conductor 31 as shown in FIG. 2.

The integrated high-frequency switch array 22 of the present embodiment is produced as follows. First, by using vacuum deposition or sputtering, a thin film containing titanium as a major component is deposited on the substrate 11 on which the coplanar high-frequency wave line (constituted by the external conductors 12 and the central conductor 13) is formed, so that a lower layer 16 of the thin film is formed on the substrate 11. Second, by using vacuum deposition, a thin film of gold is deposited on the lower layer 16 so that a middle layer 15 of the thin film is formed on the lower layer 16. Third, by using vacuum deposition or sputtering, a thin film containing titanium as a major component is deposited on the middle layer 15 so that an upper layer 14 of the thin film is formed on the middle layer 15 and the laminated thin films constitute the air-bridge 18.

In the above-described method of production, the deposition of the thin film for each of the lower layer 16 and the upper layer 14 uses a mixture of gases, containing an argon gas and a nitrogen-including gas, as an atmospheric gas for vacuum deposition or sputtering, and, during the deposition of each of the lower layer and the upper layer, partial pressures of the gases in the mixture are maintained to be constant. The nitrogen-including gas in the mixture means one or more gases selected from among $N_2$, NO, $N_2O$ and $NH_3$, and the atmospheric gas for the vacuum deposition or sputtering includes an argon gas and such nitrogen-including gas.

In the integrated high-frequency switch array 22 of the present embodiment, each of the plurality of high-frequency switches 10 has a construction that is essentially the same as the construction of the switch 10 shown in FIG. 1. In the present embodiment, the air-bridges 18 of the plurality of high-frequency switches 10 include the upper layers 14 of the thin film containing titanium as the major component, and each of the upper layers 14 has a distinct thickness among the plurality of high-frequency switches 10.

The integrated high-frequency switch array 22 produced by the above-mentioned production method is a part of a phase shifter 20 of FIG. 2. The phase shifter 20 of FIG. 2 has a construction that is similar to an equivalent circuit of a phase shifter of FIG. 4A.

Figure 4A:
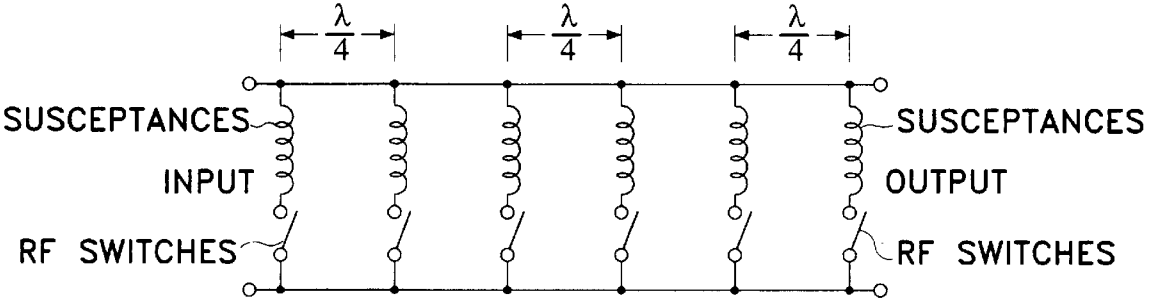
Fig. 4A Prior Art
FIG. 4A is a circuit diagram of an equivalent circuit of a conventional microwave switch array.
Figure 4B:
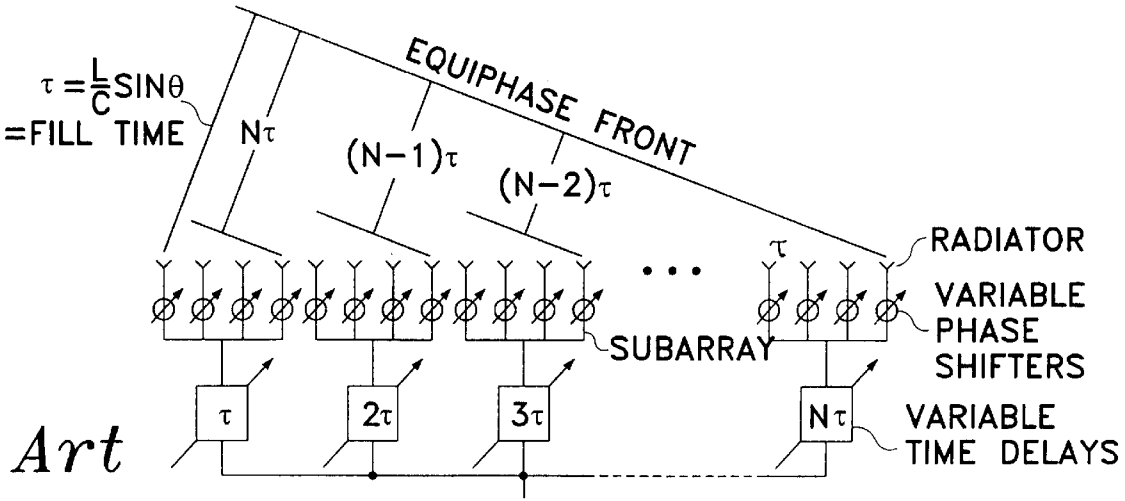
Fig. 4B Prior Art
FIG. 4B is a circuit diagram of an equivalent circuit of a phased array antenna utilizing the conventional microwave switch array of FIG. 4A.

An equivalent circuit of a conventional microwave switch array in FIG. 33 of the previously-mentioned publication (U.S. Pat. No. 5,619,061) is illustrated in FIG. 4A. An equivalent circuit of a phased array antenna (in FIG. 34*a* of the previously-mentioned publication) utilizing the conventional microwave switch array of FIG. 4A is illustrated in FIG. 4B. The phase shifter 20 of FIG. 2 requires high-speed phase shifting actions with the least possible delays as well as an increase of effective areas for other elements of the phased array antenna on which the phase shifter 20 is provided.

More specifically, in the phase shifter 20 of FIG. 2, a 1-$\mu$m thick film of gold (Au) is deposited on a substrate of gallium arsenide (GaAs) through vacuum deposition, and a coplanar high-frequency wave line (constituted by external conductors 12 and a central conductor 13) is formed on the substrate through a lift-off process. In the coplanar high-frequency wave line, the central conductor 13 has a width of 40 $\mu$m, and the external conductors 12 are separated from each other at a distance of 80 $\mu$m.

The lift-off process is a known pattern transfer method in which unmasked portions of a film are removed by etching. In the lift-off process, a lithographic mask (or a photoresist pattern) is made first, the surface layer (most often metalization) is deposited on the substrate, and then the unwanted portions of the film are lifted off by dissolving the mask.

The phase shifter 20 of FIG. 2 has an operating frequency of 60 GHz, and six reactances 21A, 21B, . . . , 21F are provided in the phase shifter 20 at a distance of a quarter wavelength (¼ lambda) of the wave traveling on the central conductor 13. Further, six high-frequency switches 10 of the present invention (also indicated by reference numerals 101, 102, . . . , in FIG. 2) are provided along the coplanar high-frequency wave line between the input and the output as shown in FIG. 2.

In the present embodiment, the titanium film of the lower layer 16 of each of the switches 10 is deposited on the substrate 11 on which the coplanar high-frequency wave line is formed, by using a vacuum deposition device (not shown). The vacuum deposition device is filled with a mixture of gases containing an argon gas Ar (99%) and a nitrogen gas $N_2$ (1%) as an atmospheric gas for vacuum deposition. During the deposition of the lower layer 16, the pressure of atmospheric gas is maintained at a constant level of $1.33\times 10^{-4}$ Pa. The titanium film of the lower layer 16 has a thickness of 5 nm (nanometers).

After the back pressure is lowered to $1\times10^{-5}$ Pa or below, the gold film of the middle layer 15 of each of the switches 10 is deposited on the lower layer 16 by using the vacuum deposition device. The gold film of the middle layer 15 has a thickness of 800 nm.

Similar to the lower layer 16, the titanium film of the upper layer 14 of each of the switches 10 is deposited on the middle layer 15 by using the vacuum deposition device, so that each of the upper layers 14 of the switches 10 on the substrate has a distinct thickness among the switches 10. The vacuum deposition device is filled with a mixture of gases containing an argon gas Ar (99%) and a nitrogen gas $N_2$ (1%) as an atmospheric gas for vacuum deposition. During the deposition of the upper layers 14, the pressure of atmospheric gas is maintained at a constant level of $1.33\times 10^{-4}$ Pa. Further, during the deposition of the upper layers 14, a shading plate immediately preceding the substrate is moved in a stepwise manner from the input to the output along the wave line, and the vacuum deposition is performed so that the upper layers 14 of the switches 10 have different thicknesses: 5 nm, 5.5 nm, 6 nm, 6.5 nm, 7 nm, 7.5 nm. Finally, the laminated thin films, constituting the air-bridges 18, are formed at predetermined positions in the switches 10 through the lift-off process.

The air-bridge 18 of each of the switches 10 has a width of 40 $\mu$m and a length of 200 $\mu$m. The air-bridge 18 of each of the switches 10 has a height of 1.2 $\mu$m on the coplanar high-frequency wave line.

Figures 3A, 3B:
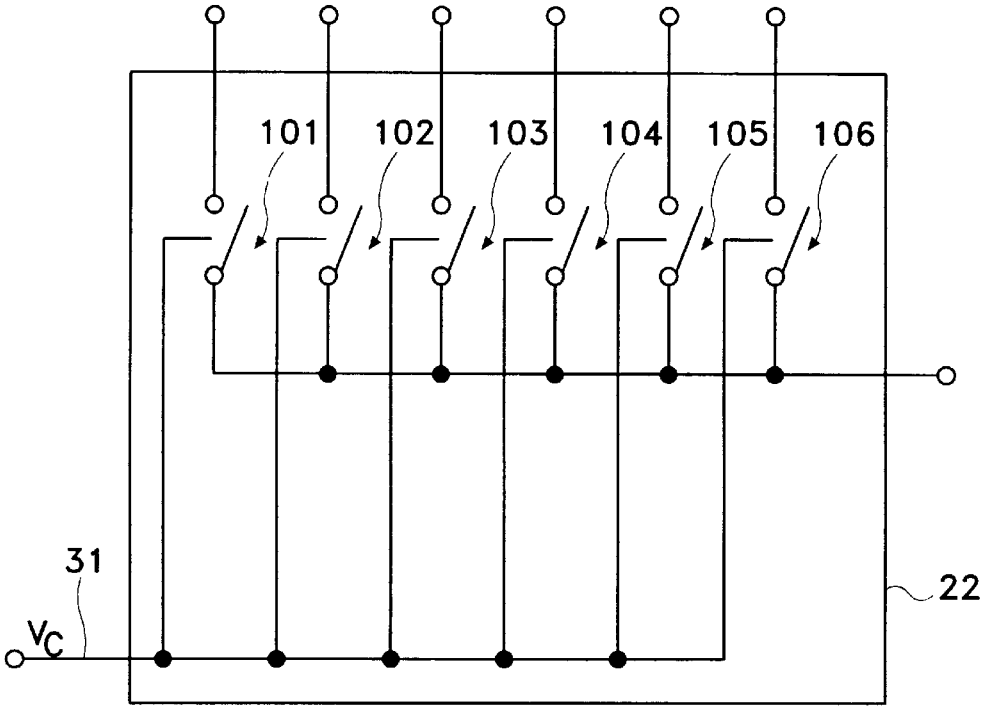
FIG. 3A is a circuit diagram of an equivalent circuit of the integrated high-frequency switch array of FIG. 2.
FIG. 3B is a diagram for explaining an operation of the integrated high-frequency switch array of FIG. 2.

FIG. 3A shows an equivalent circuit of the integrated high-frequency switch array 22 of FIG. 2. FIG. 3B shows an operation of the integrated high-frequency switch array 22 of FIG. 2.

In the phase shifter 20 of FIG. 2, the central conductor 13 acts as the shared control-signal conductor 31 which generates an actuation voltage between the wave line and the air-bridge 18 of each of the switches 10. A variable bias voltage Vc generated by a bias-voltage applying circuit (not shown) is supplied through the shared control-signal conductor 31 (the central conductor 13) to each of the switches 101–106 of the integrated high-frequency switch array 22, and respective switching ON/OFF actions of the switches 101–106 in response to the supplied bias voltage Vc are observed. FIG. 3B shows the result of the switching ON/OFF actions of the switches 101–106. In FIG. 3B, the value "0" indicates an OFF-state of the switch of concern and the value "1" indicates an ON-state of the switch of concern.

Voltages V1, V2, V3, V4, V5 and V6 indicated in FIG. 3B are six distinct actuation voltages at which one of the switches 101–106 is sequentially turned to the ON-state when the supplied bias voltage Vc is increased. As a result of the observation, the actuation voltages V1 through V6 of the switches 101 through 106 are found to substantially accord with equal six divisions between 30 V and 40 V.

The phase-shifting amount of each of the reactances 21A through 21F is set at about 51.4 degrees. When a phase-shifting amount of the phase shifter 20 when the supplied bias voltage Vc is increased from less than 30 V to 40 V is measured using a network analyzer (not shown), it is observed that the measured phase shift amount changes from 0 to 308 degrees at six stages in response to the supplied bias voltage Vc.

The integrated high-frequency switch array 22 of the present embodiment can be formed on the substrate having a size of 5×10 mm. It is found that the delay of phase shifting actions of the phase shifter 20 is below 0.1 ms (milliseconds), and it is equivalent to the delay of switching ON/OFF actions of the high-frequesncy switch 10 having the air-bridge 18.

Next, a description will be given of a comparative example of the conventional microwave switch array of the above publication (U.S. Pat. No. 5,619,061), for the purpose of comparison between the above publication and the present invention.

A conventional microwave switch array in which six microwave switches according to the above publication are provided along a coplanar high-frequency wave line between the input and the output is produced such that the conventional microwave switch array has a construction that is essentially the same as the construction of the integrated high-frequency switch array 22 of the first embodiment of FIG. 2 except for an air-bridge of each of the microwave switches having a single thin film of gold.

In the conventional microwave switch array of the above publication, six control-signal conductors provided on the substrate are required to supply fixed actuation voltages to the respective microwave switches so as to control individual switching ON/OFF actions of the microwave switches. Further, in order to separately control the microwave switches with the fixed actuation voltages, it is necessary to provide six capacitors between the microwave switches and the coplanar high-frequency wave line to avoid the flow of DC current therebetween. For these reasons, the substrate on which the conventional microwave switch array of the above publication is formed has the size of 10×10 mm which is the double of the size of the integrated high-frequency switch array 22 of the present embodiment.

In contrast, the integrated high-frequency switch array 22 of the present embodiment is effective in providing high-speed phase shifting actions with the least possible delays as well as an increase of effective areas for other elements of the phased array antenna on which the phase shifter 20 is provided.

In the integrated high-frequency switch array 22 of the present embodiment, the air-bridge 18 of each high-frequency switch 10 is formed by a plurality of laminated thin films, the laminated thin films having variable internal stresses that are adjustable to match a particular actuation voltage selected for the switch 10. As previously described with respect to FIG. 3B, it is possible for the integrated high-frequency switch array 22 of the present embodiment to achieve the above-mentioned features. Further, the integrated high-frequency switch array 22 of the present embodiment can be produced by using the integrated circuit fabrication processes mentioned above, and it can be easily produced with low cost.

Next, a description will be given of a second embodiment of the integrated high-frequency switch array of the present invention. In the following, the elements in the present embodiment which are essentially the same as corresponding elements in the first embodiment described above are designated by the same reference numerals as in FIG. 1 through FIG. 3B, and a duplicate description thereof will be omitted.

An integrated high-frequency switch array 22 of the present embodiment is produced by a production method similar to that of the first embodiment described above. The integrated high-frequency switch array 22 of the present embodiment is a part of the phase shifter 20 of FIG. 2, and the phase shifter 20 has a construction that is similar to the equivalent circuit of the phase shifter of FIG. 4A.

Each of the plurality of high-frequency switches 10 has a construction that is essentially the same as the construction of the switch 10 shown in FIG. 1. In the present embodiment, the air-bridges 18 of the switches 10 include the upper layers 14 of the thin film containing titanium as the major component, and each of the upper layers 14 has a distinct pattern among the switches 10.

In the integrated high-frequency switch array 22 of the present embodiment, twelve high-frequency switches 10 are provided along the coplanar high-frequency wave line between the input and the output as shown in FIG. 2, and it provides twelve stages of the phase-shifting amount for the phase shifter 20 of FIG. 2.

In the present embodiment, the phase shifter 20 has the operating frequency of 60 GHz, and twelve reactances 21A, 21B, . . . , 21L are provided in the phase shifter 20 at a distance of the quarter wavelength (¼ lambda) of the wave traveling on the central conductor 13. The phase-shifting amount of each of the reactances 21A through 21L is set at about 26 degrees. Other elements of the present embodiment are essentially the same as corresponding elements of the first embodiment described above.

Before observing an operation of the integrated high-frequency switch array 22 of the present embodiment, a comparative example of the integrated high-frequency switch array having twelve high-frequency switches 10 provided along the coplanar high-frequency wave line between the input and the output, the titanium films of the upper layers 14 of the twelve switches 10 having different thicknesses: 5 nm, 5.23 nm, 5.46 nm, . . . , 7.5 nm is prepared by using the production method of the first embodiment described above. Switching ON/OFF actions of this example when the supplied bias voltage Vc is increased are observed.

However, as a result of the observation, it is found that there is a defective case in which two of the twelve switches 10 are simultaneously turned to the ON-state when the supplied bias voltage Vc is increased to a certain actuation voltage.

Accordingly, in the present embodiment, the titanium films of the upper layers 14 of the switches 10 are prepared at a constant thickness (5 nm) by using vacuum deposition, and by using the lift-off process, each of the upper layers 14 is prepared to have a distinct pattern among the switches 10. More specifically, a lithographic mask is made first, the titanium film of the upper layer 14 of each of the switches 10 is deposited on the middle layer 15 (the gold film) with the constant thickness (5 nm) by using vacuum deposition, and then the unwanted portions of the titanium film are lifted off by dissolving the mask, so that a distinct pattern for each of the switches 10 is formed in the upper layer 14. The different patterns of the upper layers 14 of the switches 10 are, for example, in a mesh-like formation. In the present embodiment, the upper layers 14 of the twelve switches 10 have different aperture ratios: 10%, 15%, 20%, 25%, 30%, 35%, 40%, 45%, 50%, 55%, 60%, 65%. The aperture ratio of each of the upper layers 14 means the ratio of the area of the titanium-removed portions to the area of the mesh-like titanium pattern in the upper layer 14.

Switching ON/OFF actions of the integrated high-frequency switch array 22 of the present embodiment when the supplied bias voltage Vc is increased are observed. As a result of the observation, actuation voltages V1 through V12 of the twelve switches 10 of the present embodiment are found to substantially accord with equal twelve divisions between 30 V and 40 V.

The integrated high-frequency switch array 22 of the present embodiment can be formed on the substrate having a size of 5×10 mm. It is found that the delay of phase shifting actions of the phase shifter 20 is below 0.1 ms (milliseconds), and it is equivalent to the delay of switching ON/OFF actions of the high-frequesncy switch 10 having the air-bridge 18.

Accordingly, the integrated high-frequency switch array 22 of the present embodiment is effective in providing high-speed phase shifting actions with the least possible delays as well as an increase of effective areas for other elements of the phased array antenna on which the phase shifter 20 is provided.

In the integrated high-frequency switch array 22 of the present embodiment, the air-bridge 18 of each high-frequency switch 10 is formed by a plurality of laminated thin films, the laminated thin films having variable internal stresses that are adjustable to match a particular actuation voltage selected for the switch. Further, the integrated high-frequency switch array 22 of the present embodiment can be produced by using the integrated circuit fabrication processes mentioned above, and it can be easily produced with low cost. In addition, the integrated high-frequency switch array 22 of the present embodiment is effective in increasing the number of stages of the phase-shifting amount for the phase shifter.

Next, a description will be given of another embodiment of the high-frequency switch of the present invention. In the following, the elements in the present embodiment which are essentially the same as corresponding elements in the first embodiment described above are designated by the same reference numerals as in FIG. 1 through FIG. 3B, and a duplicate description thereof will be omitted.

A high-frequency switch 10 of the present embodiment is produced by a production method similar to that of the first embodiment described above. In the high-frequency switch 10 of the present embodiment, the laminated thin films of the air-bridge 18 include an upper layer 14 of a first conductive material, a middle layer 15 of a second conductive material, and a lower layer 16 of a third conductive material, the middle layer 15 being interposed between the upper layer 14 and the lower layer 16. Further, in the high-frequency switch 10, the second conductive material of the middle layer 15 is gold, and the first and third conductive materials of the upper and lower layers 14 and 16 contain titanium as a major component, each of the upper and lower layers 14 and 16 having a thickness in a range of 2 to 8 nm, the thickness of each of the upper and lower layers 14 and 16 being in a range of $1/10000$ to $1/100$ of a thickness of the middle layer 15.

When producing the high-frequency switch 10 of the present embodiment, it is observed that there is a preferred range or relationship of the thicknesses of the laminated thin films of the air-bridge 18 that achieves desired switching ON/OFF actions of the high-frequency switch 10. In order to determine the preferred range or relationship of the thicknesses of the laminated thin films of the air-bridge 18, experiments are conducted for various samples of the integrated high-frequency switch arrays 22 of the first embodiment described above. In such samples, the thicknesses of the thin films of the upper, middle and lower layers 14, 15 and 16 are changed to a certain extent, and switching ON/OFF actions of them when the supplied bias voltage Vc is increased are observed in order to determine the preferred range or relationship of the thicknesses of the thin films of the layers 14–16.

As a result of the observation, the desired switching ON/OFF actions are found in the samples with each of the upper and lower layers 14 and 16 having a thickness in a range of 2 to 8 nm, the thickness of each of the upper and lower layers 14 and 16 being in a range of $1/10000$ to $1/100$ of a thickness of the middle layer 15.

In the high-frequency switch 10 of the present embodiment, the air-bridge 18 is formed by a plurality of laminated thin films, the laminated thin films having variable internal stresses that are adjustable to match a particular actuation voltage selected for the switch 10, and the thickness of each of the laminated thin films being in conformity with the preferred range or relationship. The high-frequency switch 10 of the present embodiment is effective in increasing an effective area for other elements of an integrated circuit chip on which the high-frequency switch is provided while achieving high-speed switching ON/OFF actions in response to an actuation voltage. Further, the integrated high-frequency switch array 22 of the present embodiment can be produced by using the integrated circuit fabrication processes mentioned above, and it can be easily produced with low cost.

Further, the present invention is not limited to the above-described embodiments, and variations and modifications may be made without departing from the scope of the present invention.

The present invention is based on Japanese priority application No. 10-072,234, filed on Mar. 20, 1998, the entire contents of which are hereby incorporated by reference.

What is claimed is:

1. A high-frequency switch in which external conductors and a central conductor are provided on a substrate, the external conductors and the central conductor constituting a coplanar high-frequency wave line on the substrate, the high-frequency switch including:

a deflectable air-bridge held on the external conductors via an air gap and extending out over the central conductor, the air-bridge being deflectable by an electrostatic field created by an actuation voltage applied between the wave line and the air-bridge; and a control-signal conductor for generating the actuation voltage between the wave line and the air-bridge;

wherein the central conductor acts as the control-signal conductor which generates the actuation voltage between the wave line and the air-bridge, wherein the air-bridge contains a plurality of laminated thin films, the laminated thin films having variable internal stresses that are adjustable to match a particular actuation voltage selected for the switch.

2. A high-frequency switch according to claim 1, wherein the laminated thin films of the air-bridge include an upper layer of a first conductive material, a middle layer of a second conductive material, and a lower layer of a third conductive material, the middle layer being interposed between the upper layer and the lower layer.

3. A high-frequency switch according to claim 2, wherein the second conductive material of the middle layer is gold, and the first and third conductive materials of the upper and lower layers contain titanium as a major component, each of the upper and lower layers having a thickness in a range of 2 to 8 nm, the thickness of each of the upper and lower layers being in a range of $1/10000$ to $1/100$ of a thickness of the middle layer.

4. A high-frequency switch according to claim 1, wherein, when the actuation voltage is applied between the wave line and the air-bridge through the control-signal conductor, the air-bridge is deflected toward the substrate until a bottom of the air-bridge makes contact with the central conductor, the deflected air-bridge closing the switch, and with no voltage applied between the wave line and the air-bridge, the air-bridge remains parallel to a surface of the substrate, so that the switch is open.

5. An integrated high-frequency switch array having a plurality of high-frequency switches formed on a substrate and connected to a shared control-signal conductor, in which external conductors and a central conductor are provided on the substrate, the external conductors and the central conductor constituting a coplanar high-frequency wave line on the substrate, each of the plurality of high-frequency switches including a deflectable air-bridge held on the external conductors via an air gap and extending out over the central conductor, the air-bridge being deflectable by an electrostatic field created by an actuation voltage applied between the wave line and the air-bridge, the central conductor acting to generate the actuation voltage between the wave line and the air-bridge of each high-frequency switch, the air-bridge of each high-frequency switch containing a plurality of laminated thin films, the laminated thin films having variable internal stresses that are adjustable to match a particular actuation voltage selected for the switch, wherein the air-bridges of the plurality of high-frequency switches include at least one thin film having a distinct thickness among the plurality of high-frequency switches.

6. An integrated high-frequency switch array having a plurality of high-frequency switches formed on a substrate and connected to a shared control-signal conductor, in which external conductors and a central conductor are provided on the substrate, the external conductors and the central conductor constituting a coplanar high-frequency wave line on the substrate, each of the high-frequency switches including a deflectable air-bridge held on the external conductors via an air gap and extending out over the central conductor, the air-bridge being deflectable by an electrostatic field created by an actuation voltage applied between the wave line and the air-bridge, the central conductor acting to generate the actuation voltage between the wave line and the air-bridge of each high-frequency switch, the air-bridge of each high-frequency switch containing a plurality of laminated thin films, the laminated thin films having variable internal stresses that are adjustable to match a particular actuation voltage selected for the switch, wherein the air-bridges of the plurality of high-frequency switches include at least one thin film having a distinct pattern among the plurality of high-frequency switches.

* * * * *